United States Patent [19]

Hirabayashi et al.

[11] Patent Number: 4,596,971

[45] Date of Patent: Jun. 24, 1986

[54] MAGNETIC CIRCUIT DEVICE

[75] Inventors: Yasuyuki Hirabayashi; Hiroyuki Sono, both of Chiba, Japan

[73] Assignee: TDK Corporation, Tokyo, Japan

[21] Appl. No.: 755,264

[22] Filed: Jul. 15, 1985

[30] Foreign Application Priority Data

Jul. 26, 1984 [JP] Japan ..... 59-155929
Jul. 31, 1984 [JP] Japan ..... 59-116216[U]
Jul. 31, 1984 [JP] Japan ..... 59-116217[U]

[51] Int. Cl.[4] ..... H01H 9/00
[52] U.S. Cl. ..... 335/205; 335/207
[58] Field of Search ..... 335/229, 230, 234, 205, 335/206, 207

[56] References Cited

U.S. PATENT DOCUMENTS 3,055,999 9/1962 Lucas ..... 335/207 X
3,369,205 2/1968 Hamrick ..... 335/207 X
3,518,592 6/1970 Bosch ..... 335/234
3,995,243 11/1976 Malmborg ..... 335/229
4,321,570 3/1982 Tsunefuji ..... 335/229
4,481,389 11/1984 Johnson ..... 335/229

*Primary Examiner*—George Harris
*Attorney, Agent, or Firm*—Robert Scobey

[57] ABSTRACT

A magnetic circuit device suitable for use in a magnetic catch having a switching function, a slide switch or a sensor for detecting locations of a movable member has been found. The magnetic circuit device comprises a main permanent magnet (1) having a pair of magnetic poles (N, S) on opposite faces, a pair of yoke pieces (2) lying on the faces, a movable piece (4) made of magnetic material capable of engaging with first ends of the yoke pieces (2), and a sub-permanent magnet (6) movably disposed near second ends of the yoke pieces (2) opposite to the first edges so that when the movable piece (4) is attracted to the first ends, the sub-permanent magnet (6) is attracted to the second ends, and when the movable piece (4) is made break away from the first ends, the sub-permanent magnet (6) breaks away from the second ends. Movement of the sub-magnet (6) can be utilized to control electrical connection of contacts (8A, 8B) of a switching mechanism.

6 Claims, 19 Drawing Figures

MAGNETIC CIRCUIT DEVICE

BACKGROUND OF THE INVENTION

The present invention relates to a magnetic circuit device, and relates more particularly to a magnetic circuit device suitable for use in a magnetic catch having a switching function, a slide switch or a sensor for detecting locations of a movable member.

A prior magnetic catch is described in, for instance, U.S. Pat. No. 3,057,650. FIG. 1 is a side view of this prior magnetic catch. In this figure, a magnetic catch is composed of a flat rectangular permanent magnet 1 and a pair of flat yoke pieces 2. The magnet 1 has a pair of magnetic poles which are formed on its opposite faces. The yoke pieces 2 made of magnetic material such as iron are mounted on opposite pole faces of the magnet 1, respectively. End portions of yoke pieces 2 are projected outwardly from faces of the magnet 1 in the longitudinal direction. The magnetic catch thus arranged is mounted on a stationary part (not shown) of the door or the like. An armature piece 4 made of magnetic material such as iron is secured to a moving part 5 of the door so as to correspond to pole faces of the yoke pieces 2. With this arrangement, when the door is closed, the armature piece 4 is attracted toward pole faces of the yoke pieces 2 by the magnetomotive force resulting from the magnet 1 and bridges those pole faces, so that the door is held in a closed position. In other words, a magnetic circuit through the armature piece 4 is formed.

However, this prior magnetic catch has only the function of holding the door in the closed position. Therefore, in order to detect whether the door utilized in a copying machine for example is in the closed position or not, the use of a detecting device such as a limit switch or a micro-switch is required besides the magnetic catch. This brings about the disadvantages that parts for the detecting device must be provided independent of parts for the magnetic catch, which leads to high cost, and that a space for attaching the detecting device must be provided in addition to one for the catch.

SUMMARY OF THE INVENTION

It is an object, therefore, of the present invention to overcome the disadvantages of a prior magnetic catch by providing a magnetic catch having a novel magnetic circuit structure.

It is also object of the present invention to provide a magnetic catch having a switching function.

The present magnetic circuit structure is applicable not only to a magnetic catch but also a slide switch or a sensor for detecting locations of a movable member.

The above and other objects are attained by a magnetic circuit device comprising a main permanent magnet having a pair of magnetic poles on its opposite faces, a pair of yoke pieces lying on the opposite faces, a movable magnetic piece capable of engaging with first ends of the yoke pieces, and a sub-permanent magnet disposed movably near second ends of the yoke pieces opposite to the first edges so that when the movable piece is attracted to the first ends, the sub-permanent magnet is attracted to the second ends, and when the movable piece breaks away from the first ends, the sub-permanent magnet breaks away from the second ends.

Therefore, the movement of the sub-permanent magnet can be utilized to control ON/OFF states of a switch.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
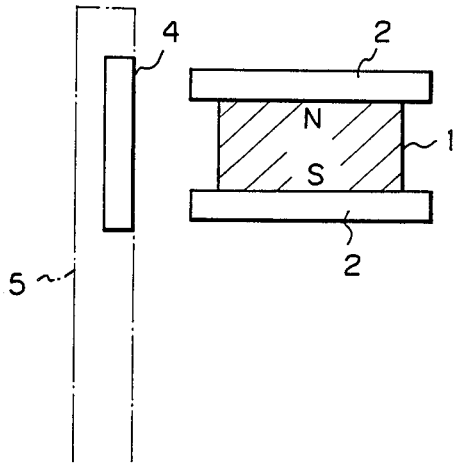
Fig. 1 PRIOR ART
FIG. 1 is a side view of a conventional magnetic catch.
Figure 2:
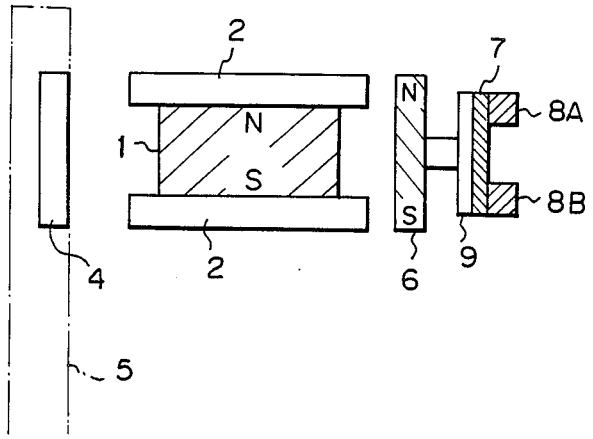
FIG. 2 is a side view of the first embodiment according to the present invention when the armature piece is away from the front ends of the yoke pieces.
Figure 3:
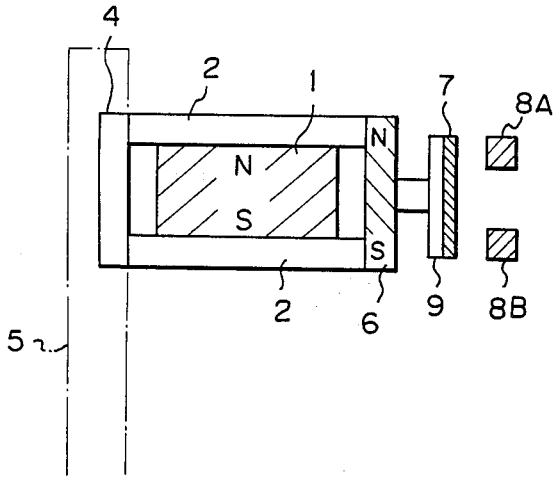
FIG. 3 is a side view of the first embodiment when the armature piece is in contact with the front faces of the armature piece.

FIGS. 2 and 3 are side views of a first embodiment of the present invention. These figures show two respective operating modes of the present embodiment as will be explained later. In these figures, identical numerals denote identical elements in FIG. 1. The feature of the present embodiment is the presence of a sub-permanent magnet 6, a movable contact 7 and stationary contacts 8A, 8B. The flat rectangular sub-magnet 6 is disposed so as to be opposite to rear ends of the yoke pieces 2. The sub-magnet 6 has two different poles N, S on its face with the N pole opposite to the rear end of one of the yoke pieces 2 which is on the N pole side. Of course, the S pole of the sub-magnet is opposite to the rear end of the other on the S pole side. On the face of the sub-magnet 6 opposite to its face having poles, there is provided an insulation resin 9 whose cross section has the T-shaped configuration. The movable contact 7 made of electrically conductive material is attached to the support member 9. The spaced stationary contacts 8A, 8B are disposed so as to be opposite to the surface of the contact 7. The assembly composed of the sub-magnet 6, the insulation resin 9 and the contact 7 is so mounted by a support member (not shown) that the assembly is freely movable from the position where the sub-magnet 6 butts against rear ends of the yoke pieces 2 to the position where the contact 7 bridges the stationary contacts 8A and 8B.

The description will be given of operations of the present embodiment.

The present embodiment has two operational modes as shown in FIGS. 2 and 3. For the sake of easy understanding of the modes, the following three cases will be now considered.

Figure 4:
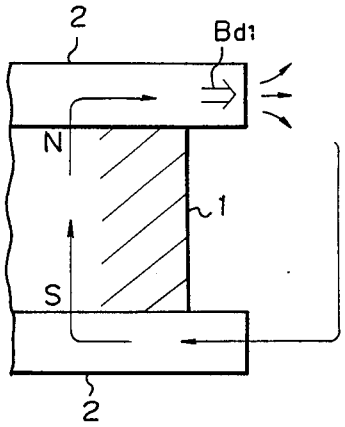
FIG. 4 is an explanation view showing the flux density in the yoke piece resulting from the main magnet.
Figure 5:
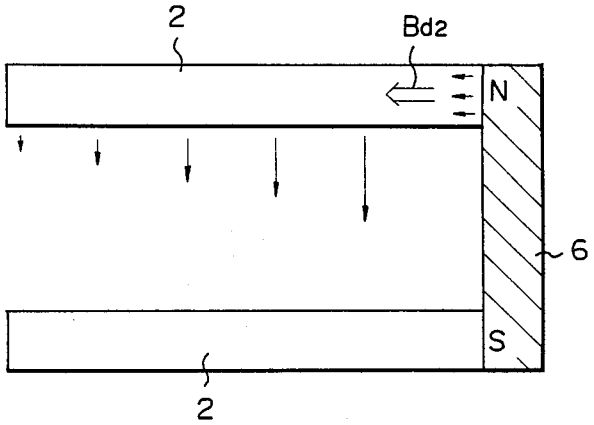
FIG. 5 is an explanation view showing the flux density in the yoke piece resulting from the sub-magnet.
Figure 6:
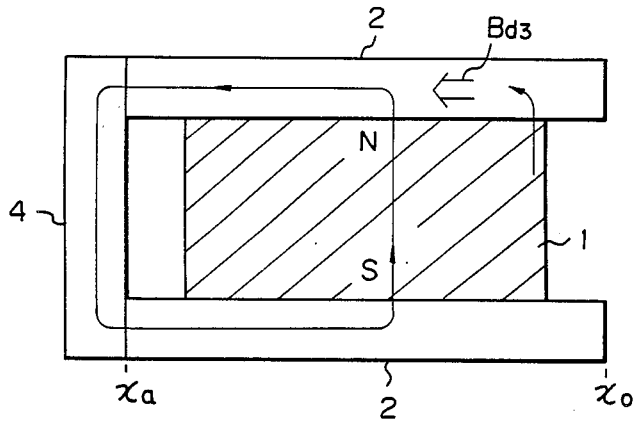
FIG. 6 is an explanation view showing the flux density in the yoke piece resulting from the main magnet when the armature piece is attached to the front ends of the yoke pieces.
Figure 7:
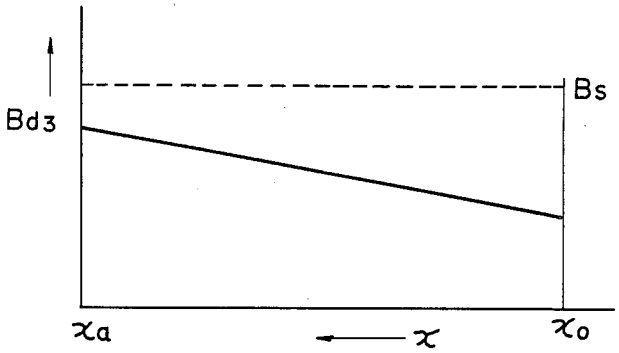
FIG. 7 is a graph showing the variation of the flux density $Bd_3$ as a function of the distance x along the yoke piece.

The first case to be considered is such that the presence of the armature piece 4 and the sub-magnet 6 shown in FIG. 2 or FIG. 3 is disregarded as shown in FIG. 4. In this case, only the main magnet 1 generates the magnetic flux indicated by the narrow arrows, and the flux density $Bd_1$ in the yoke piece 2 on the N pole side has the direction indicated by the heavy arrow. The second case is such that the presence of the main magnet 1 and the armature piece 4 is disregarded and the rear ends of the yoke pieces 2 butts against the pole face of the sub-magnet 6 as shown in FIG. 5. In this case, only the sub-magnet 6 generates the magnetic flux indicated by the narrow arrows, and the flux density $Bd_2$ in the yoke piece on the N pole side has the direction indicated by the heavy arrow. The third case is such that the presence of the sub-magnet 6 is disregarded and the armature piece 4 is attracted to the front ends of the yoke pieces 2 as shown in FIG. 6. In this case, only the main magnet 1 generates the magnetic flux indicated by the looped arrow, and the flux density $Bd_3$ in the yoke piece 2 on the N pole side has the direction indicated by the heavy arrow. Furthermore, in the third case, when the location of the rear ends of the yoke pieces 2 is indicated by $x_o$ and the location of the front ends of the yoke pieces 2 by $x_a$, the flux density $Bd_3$ increases with increasing the distance x which is measured from $x_o$ along the longitudinal direction toward $x_a$ as shown in FIG. 7 where $B_s$ shows the saturation flux density of the yoke pieces 2.

On the basis of consideration of the above three cases, the two operating modes will be easily understood.

The one of two operating mode is shown in FIG. 3 in which the armature piece 4 is attracted to and then butts against the front ends of the yoke pieces 2. In this case, the flux density in the yoke piece 2 on the N pole side which results from the main magnet 1 is $Bd_3$ and the flux density in that yoke piece 2 which results from the sub-magnet 6 is $Bd_2$, $Bd_3$ having the same direction as $Bd_2$. Thus, an attractive force is exerted between the rear ends of the yoke pieces 2 and the poles of the sub-magnet 6, causing the sub-magnet 6 to engage with the rear ends of the yoke pieces 2. As a result, the movable contact 7 which cooperates with the sub-magnet 6 moves along the longitudinal direction toward the rear ends of the yoke pieces 2, and the electrical connection between the contacts 8A and 8B is thus in the OFF state.

Figure 9:
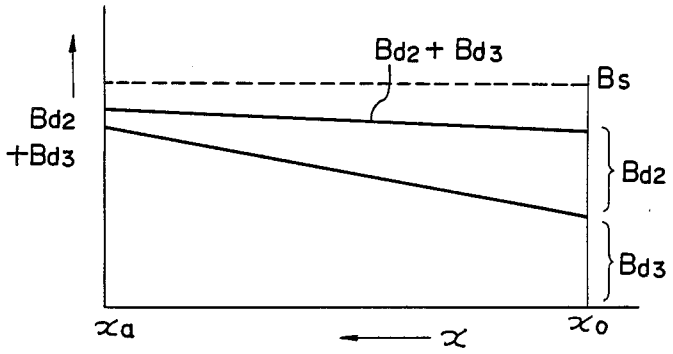
FIG. 9 is a graph showing the variation of the resultant flux density $Bd_2+Bd_3$ in the case of FIG. 8 as a function of the distance x.
Figure 11:
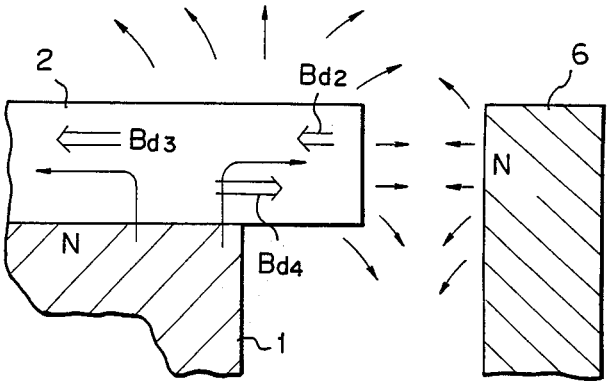
FIG. 11 is an explanation view showing the flux density in the rear end portion of the yoke piece when the yoke piece is in the magnetic saturation.

FIG. 9 shows the variation of the resultant flux density $Bd_2+Bd_3$ in the yoke piece 2 as a function of the distance x. As shown in this figure, the saturation flux density $B_s$ of the yoke pieces 2 is preferably greater than the resultant flux density at any points in the yoke pieces 2. The reason is as follows. If the yoke pieces is in the magnetic saturation, a flux density $Bd_4$ whose direction is opposite to the direction of $Bd_2$ and $Bd_3$ will generates in the yoke piece 2 on the N pole side as shown in FIG. 11. In this case, when the flux density $Bd_4$ is greater than the flux density $Bd_2$, a repulsion force generates near the rear ends of the yoke pieces 2. Therefore, even if the armature piece 4 engages with the front ends of the yoke pieces 2, the sub-magnet 6 will be never attracted to the rear ends of the yoke pieces 2.

In the mode shown in FIG. 3, when the armature piece 4 breaks away from the front ends of the yoke pieces 2 by opening the door, the direction of the flux density $B_d$ becomes opposite to that of the flux density $Bd_2$. In this case, when $Bd_1>Bd_2$ is satisfied, the sub-magnet 6 breaks away from the rear ends of the yoke pieces 2. Therefore, under this condition the breakaway of the armature piece 4 corresponds to that of the sub-magnet 6. Thus, the connection between the contacts 8A and 8B is established as shown in FIG. 2. When $Bd_2>Bd_1$, the sub-magnet 6 can not break away from the rear ends because the attraction force is exerted therebetween. Further, the condition of $Bd_2=Bd_1$ is unsuitable because the repulsion force is never generated.

As apparent from the foregoing, in order to make the movement of the armature piece 4 correspond to that of the sub-magnet 6, that is, to obtain the two operating modes, the following two conditions must be satisfied.

(1) $Bd_1>Bd_2$ (2) The yoke pieces 2 are not in the magnetic saturation, or the condition of $Bd_4<Bd_2$ is satisfied even when the yoke pieces 2 are magnetically saturated.

According to the first embodiment, the connection between the stationary contacts 8A and 8B is controlled in accordance with the movement of the sub-magnet 6 which corresponds to the movement of the armature piece 4. Therefore, the present embodiment can provide the magnetic catch having the switching function for detecting whether the door is closed or not. Furthermore, the present embodiment is simple in structure, small in size and cheap since it utilizes only two permanent magnets without any coil.

In the first embodiment, it should be noted that the most important feature is movement of the sub-magnet 6 along the longitudinal direction, and said movement corresponds to movement of the armature piece 4. The first embodiment utilizes this movement for driving the movable contact 7. However, many applications utilizing the movement of the sub-magnet 6 will be anticipated. For example, it may be applicable for driving a valve.

As mentioned above, the first embodiment uses the sub-magnet 6 which has two poles in its two face and which is capable of joining to rear ends of the yoke pieces 2. Such a structure of the sub-magnet 6 is suitable when the material is the same as that of the main magnet 1; for example, those magnets are made of ferrite. However, that structure is unsuitable when materials of those magnets differ from each other. Therefore, the second embodiment which is suitable for such a case will be explained below.

Figure 12:
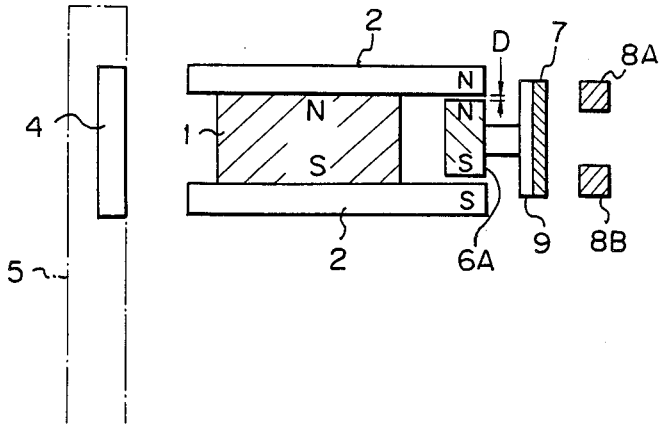
FIG. 12 is a side view of the second embodiment according to the present invention.

FIG. 12 shows the second embodiment according to the present invention. The feature of this embodiment is a sub-permanent magnet 6A which is so designed that two different magnetic poles are formed on the upper face and the lower face of the sub-magnet 6A, respectively, and its N pole face is opposite to the inner face of the yoke piece 2 on the N pole side with a given spacing D. The other elements of the second embodiment are the same as corresponding elements of the first embodiment.

The second embodiment thus configurated is suitable for the magnetic catch with the switching function when as compared with the main magnet 1, a magnetically strong permanent magnet is used as the sub-magnet 6A, for example, when the main magnet 1 is a ferrite magnet and the sub-magnet 6A is a rare earth magnet.

Figure 13:
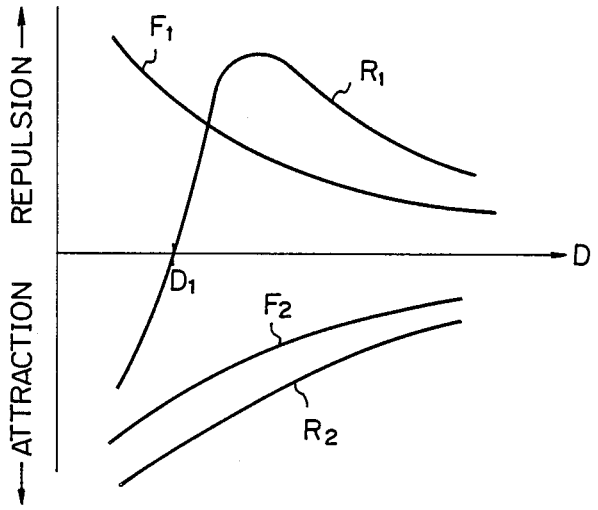
FIG. 13 is a graph showing the relation between repulsion forces and attraction forces which depends on the value of spacing D.

That reason will be explained referring to FIG. 13 which shows variation of forces exerted between the sub-magnet 6A and the rear end portions of the yoke pieces 2 as a function of the distance D in FIG. 12. In this figure, $F_1$ and $F_2$ show forces when the main magnet 1 and the sub-magnet 6A in FIG. 12 are ferrite magnets, and $R_1$ and $R_2$ show forces when the main magnet 1 is a ferrite magnet and the sub-magnet 6A is a rare earth magnet. Furthermore, $F_1$ and $R_1$ show forces when the armature piece 4 is away from the front ends of the yoke pieces 2, and $F_2$ and $R_2$ show forces when the armature piece 4 bridges the front ends. As apparent from this figure, under the condition that two magnets are made of ferrite, the repulsion force $F_1$ is exerted in spite of the value of the distance D when the armature piece 4 is away from the front pole faces, and the absorption force $F_2$ is exerted in spite of the value of the distance D when the armature piece 4 is in contact with the front ends. Therefore, the sub-magnet 6A is movable corresponding to the movement of the armature piece 4. On the other hand, under the condition that the rare earth magnet is used as the sub-magnet 6A instead of the ferrite magnet, the attraction force $R_2$ like the force $F_2$ is exerted when the armature piece 4 is in contact with the front ends of the pole pieces 2. However, when the armature piece 4 is away from the front ends, the force $R_1$ exerted between the sub-magnet 6A and the rear end portions of the yoke pieces 2 changes from repulsion to attraction at the distance $D_1$ as shown in FIG. 13. Thus, when the distance D of the spacing is smaller than the spacing $D_1$, the sub-magnet 6A can not break away from the rear ends of the yoke pieces 2. Therefore, design of the distance D is an important factor with a stronger magnet such as a rare earth magnet used as the sub-magnet 6A. Likewise, when the sub-magnet 6 in the first embodiment uses a rare earth magnet, it is required to provide a given spacing between the rear ends of the yoke pieces 2 and the corresponding face of the sub-magnet 6.

Figure 14:
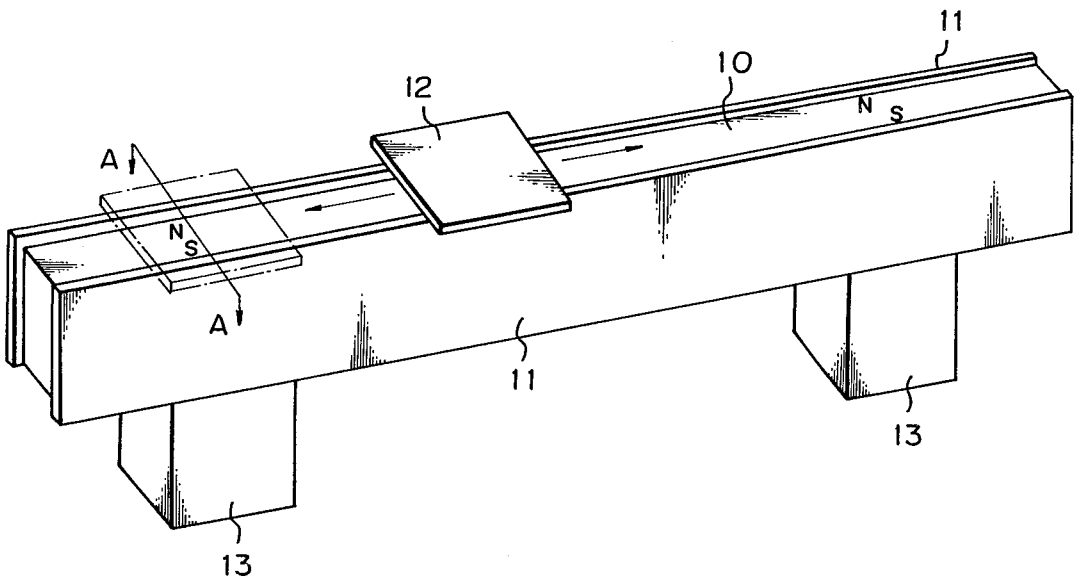
FIG. 14 is a perspective view of a slide switch obtained by utilizing two fundamental operating modes shown in FIGS. 2 and 3, respectively.
Figure 15:
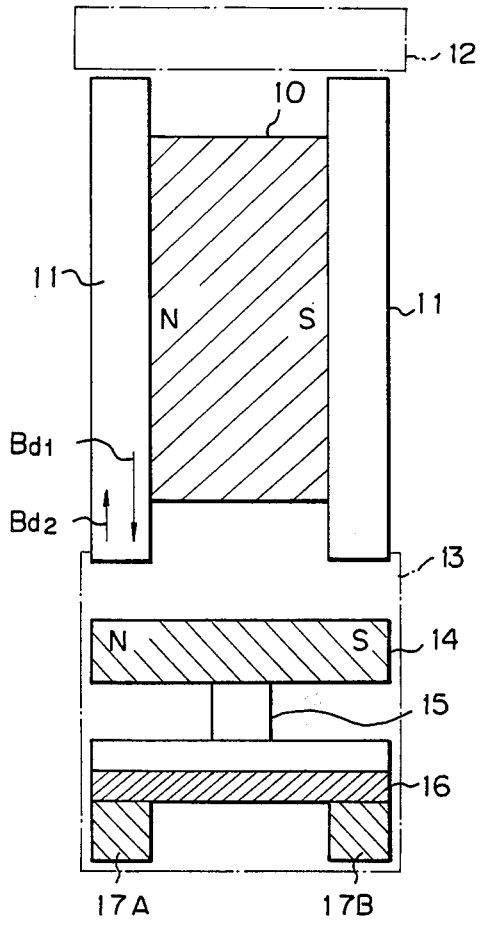
FIG. 15 is a cross sectional view along the line A—A of FIG. 14 when the magnetic piece is positioned between two adjacent housing.
Figure 16:
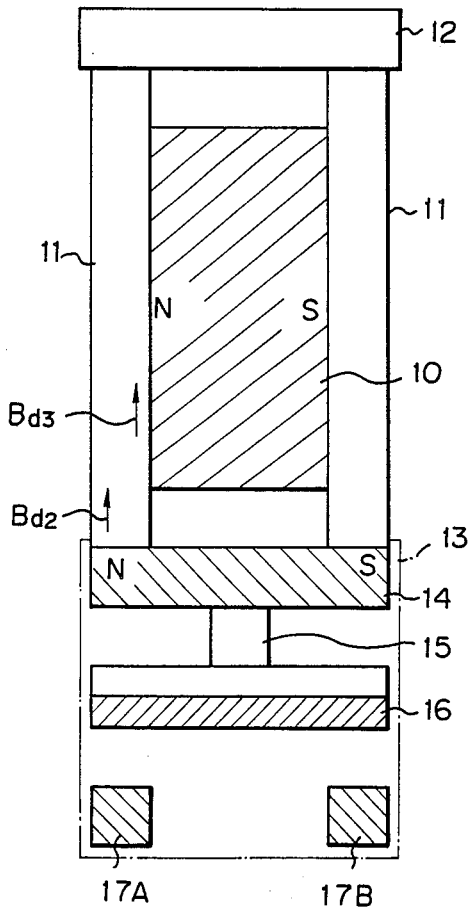
FIG. 16 is a cross sectional view along the line A—A of FIG. 14 when the magnetic piece is positioned just above the housing.

FIG. 14 is a perspective view of a slide switch obtained by utilizing two fundamental operating modes mentioned above. In this figure, a pair of elongated rectangular yoke pieces 11 are fixed to opposite faces of an elongated rectangular main magnet 10 in its thickness direction, the opposite faces having different poles. A plate-shaped magnetic piece 12 which partially bridges the upper edges of the yoke pieces 11 is mounted so as to freely side thereon in the longitudinal direction. The magnetic piece 12 acts as an actuator of the present switch. Spaced two housings 13 in the longitudinal direction are fixed to the lower edges of the yoke pieces 11. In each housing, there are provided a sub-permanent magnet 14, an insulation resin 15, a movable contact 16 and stationary contacts 17A, 17B as shown in FIG. 15 or 16. Comparing those figures with FIG. 2 or FIG. 3, it will be understood that those elements in each housing 13 are disposed in the similar way as the structure of the first embodiment. Of course, there may be provided one housing or more than three housings.

The description will be now given of operation of the present slide switch.

Figure 10:
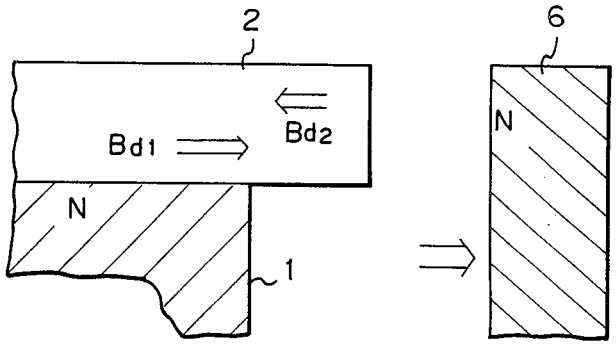
FIG. 10 is an explanation view showing the magnetic flux in the rear end portion of the yoke piece when the sub-magnet is away from the rear ends of the yoke pieces.

Now, it is considered that the magnetic piece 12 is not positioned above the housings 13 but positioned between two adjacent housings. This case is shown in FIG. 15 which is a cross sectional view along the line A—A of FIG. 14. In this case, the flux density $Bd_1$ in the lower end of the yoke piece 11 on the N pole side which results from the main magnet 10 has the direction which differs from the direction of the flux density $Bd_2$ in that lower end which results from the sub-magnet 14, as shown in FIG. 15. It will be easily understood that this relation between $Bd_1$ and $Bd_2$ in this case coincides with the relation between $Bd_1$ and $Bd_2$ shown in FIG. 10. Therefore, when $Bd_1 > Bd_2$ is satisfied, the sub-magnet 14 is away from the lower ends of the yoke pieces 11 and the electrical connection between the contacts 17A and 17B is held in ON state.

Figure 8:
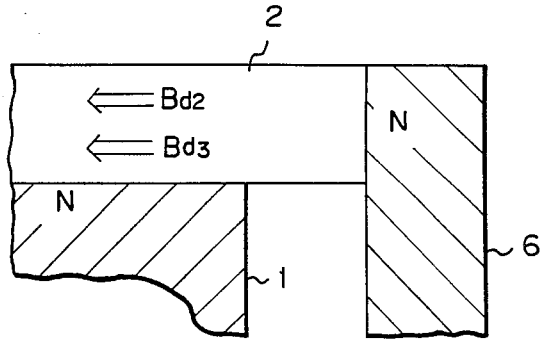
FIG. 8 is an explanation view showing the flux density in the rear portion of the yoke piece when the sub-magnet is attracted to rear ends of the yoke piece.

Next, it is considered that the magnetic piece 12 is positioned below one of the housings 13. This case is shown in FIG. 16 which is a cross sectional view along the line A—A of FIG. 14 in which the magnetic piece 12 is illustrated by the dash and dotted line. In this case, the magnetic flux $Bd_3$ in the yoke piece 11 on the N side which results from the main magnet 10 has the same direction as the magnetic flux $Bd_2$ in that yoke piece 11 which results from the sub-magnet 14, as shown in FIG. 16. It will be thus easily understood that the relation between $Bd_2$ and $Bd_3$ in this case coincides with that shown in FIG. 8. Thus, there exists the attraction force between the lower ends of the yoke pieces 11 and the pole face of the sub-magnet 14 when the condition (2) mentioned before is satisfied. At this time, the sub-magnet 14 is attracted to the lower ends of the yoke pieces 11 and then the electrical connection between the contacts 17A and 17B is held in OFF state. As a result, the slide switch can be obtained such that the ON/OFF states is magnetically controlled. It will be anticipated that this slide switch also acts as a detector for detecting locations of a movable member which cooperates with the magnetic piece 12. Of course, in order that these two modes are established, the above-mentioned two conditions must be satisfied.

Figure 17:
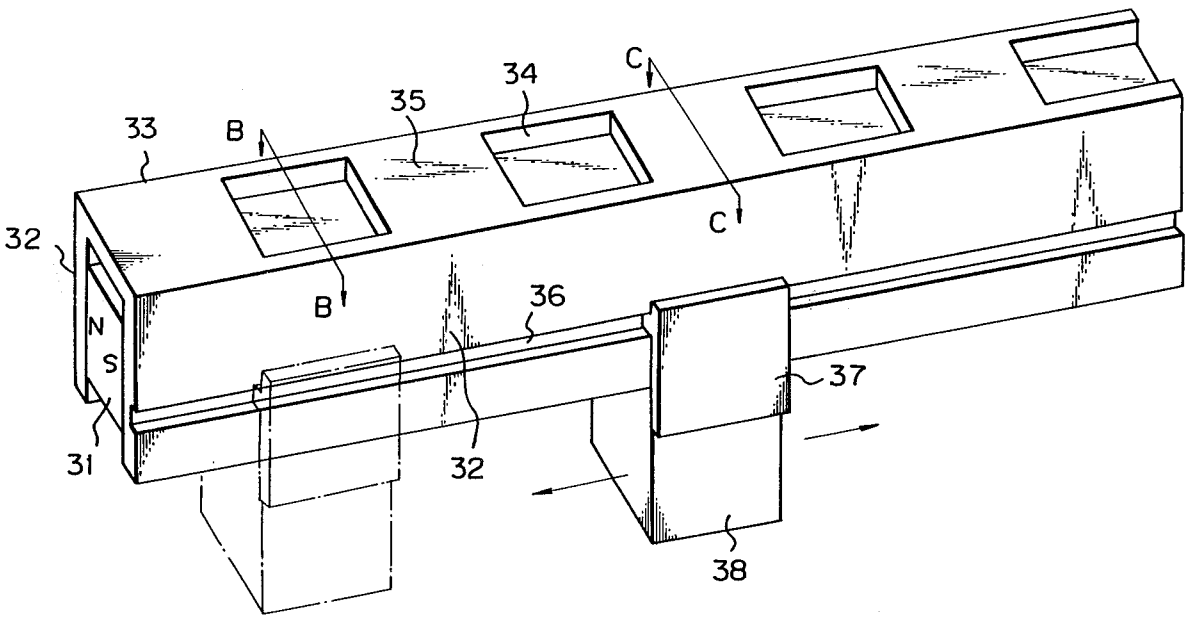
FIG. 17 is a perspective view of another slide switch obtained by utilizing two fundamental operating modes.
Figure 18:
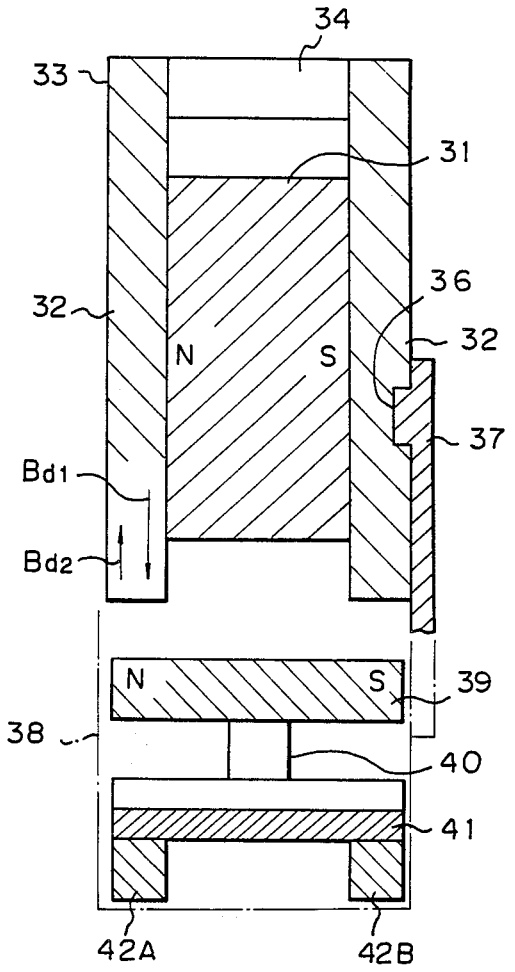
FIG. 18 is a cross sectional view along the line B—B when the housing is positioned just below that line.
Figure 19:
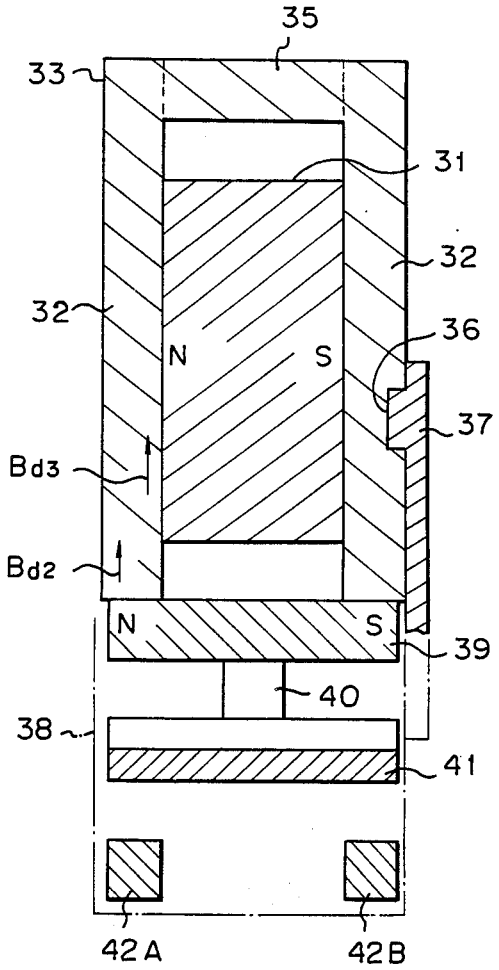
FIG. 19 is a cross sectional view along the line C—C when the housing is positioned just below that line.

FIG. 17 is a perspective view of another slide switch utilizing two operating modes shown in FIGS. 2 and 3, respectively, FIG. 18 is a cross sectional view along the line B—B of FIG. 17 when a movable housing is positioned just below that line, and FIG. 19 is a cross sectional view along the line C—C of FIG. 17 when that housing is positioned just below that line. In those figures, an elongated rectangular main magnet 31 is accommodated in the recess of a generally C-shaped magnetic member 33. The main magnet 31 made of magnetic material has two different poles on its opposite faces in its thickness direction. The top plane of the magnetic member 33 has a plurality of square windows 34, remaining portions 35 bridging partially upper edges of its opposite walls or yoke members 32. On the outer surface of one of the yoke members 32, there is provided an elongated guide groove 36 in the longitudinal direction. The groove 36 engages with a corresponding rectangular convex of a guide plate 37 attached to one surface of a housing 38, so that the housing 38 which is disposed below the lower edges of the yoke members 32 can freely slide in the longitudinal direction as shown by arrows in FIG. 17. In the housing 38, there are provided a sub-permanent magnet 39, a support member 40, a movable contact 41 and stationary contacts 42A, 42B. Those elements are identical with corresponding elements shown in FIG. 15 or 16 and also disposed in the similar manner as that figure.

The present slide switch has also two operating modes shown in FIG. 17 and FIG. 18, respectively. One of two modes is such that when the housing 38 is positioned generally below one window 34, the sub-magnet 39 is repelled by the repulsion force due to the main magnet 31 and stationary contacts 42A and 42B are then electrically connected by the contacts 41 which coacts with the sub-magnet 39 (FIG. 18). The other is such that when the housing 38 is positioned generally below a certain bridge portion 35, the sub-magnet 39 is attracted to the lower ends of the yoke members 32 and abutted thereto, stationary contacts 42A and 42B being thus disconnected (FIG. 19). Of course, in order that these two modes are established, the two conditions mentioned before must be satisfied.

What is claimed is:

1. A magnetic circuit device comprising;

a main permanent magnet having a pair of magnetic poles on its opposite faces, a pair of yoke pieces lying on said opposite faces, a movable magnetic piece capable of engaging with first ends of said yoke pieces, and a sub-permanent magnet disposed movably near second ends of said yoke pieces opposite to said first edges so that when said movable piece is attracted to said first ends, said sub-permanent magnet is attracted to said second ends, and when said movable piece is made break away from said first ends, said sub-permanent magnet breaks away from said second ends.

2. A magnet circuit device according to claim 1, wherein said device further comprises a switching mechanism which cooperates with said sub-permanent magnet.

3. A manget circuit device according to claim 2, wherein said switching mechanism comprises a movable contact coupled with said sub-permanent magnet, and stationary contacts which said movable contact bridges when said sub-permanent magnet is made break away from said first ends.

4. A magnetic circuit device according to any one of claims 1 through 3, wherein said sub-permanent magnet has two different poles which are formed on a force thereof so that N pole of said sub-permanent magnet is located so as to be opposite to one of said first ends which is on the N pole side.

5. A magnetic circuit device according to any one of claims 1 through 3, wherein said sub-permanent magnet has two different poles which are formed on opposite ends, respectively, so that N pole of said sub-permanent magnet is located so as to be opposite to the inner face of one of said yoke pieces which is on the N pole side.

6. A magnetic circuit device according to claim 1, wherein the magnetic flux density $Bd_1$ in said yoke pieces which results from said main permanent magnet is greater than the magnetic flux density $Bd_2$ in said yoke pieces which results from said sub-permanent magnet, as well as said yoke pieces are so designed as to be not in magnetic saturation with it attracted to said second ends, or the other magnetic flux density $Bd_4$ in said yoke pieces towards the sub-permanent magnet when said yoke pieces are in magnetic saturation is smaller than said flux density $Bd_2$.

* * * * *